US007028500B2

(12) United States Patent
Jeon

(10) Patent No.: US 7,028,500 B2
(45) Date of Patent: Apr. 18, 2006

(54) INDOOR UNIT FOR AIR CONDITIONER

(75) Inventor: Jeong Yong Jeon, Changwon-si (KR)

(73) Assignee: LG Electronics Inc., Seoul (KR)

( * ) Notice: Subject to any disclaimer, the term of this patent is extended or adjusted under 35 U.S.C. 154(b) by 94 days.

(21) Appl. No.: 10/756,287

(22) Filed: Jan. 14, 2004

(65) Prior Publication Data

US 2005/0132737 A1 Jun. 23, 2005

(30) Foreign Application Priority Data

Dec. 19, 2003 (KR) ..... 10-2003-0093630

(51) Int. Cl.
*F25B 47/00* (2006.01)

(52) U.S. Cl. ..... 62/298

(58) Field of Classification Search ..... 62/298, 62/299, 515; 285/12, 125.1
See application file for complete search history.

(56) References Cited

U.S. PATENT DOCUMENTS 3,882,688 A * 5/1975 Honnold, Jr. ..... 62/77
3,905,789 A * 9/1975 Carpenter ..... 62/299
4,184,661 A * 1/1980 Kushner et al. ..... 251/82
4,354,359 A * 10/1982 Hall et al. ..... 62/299
4,410,033 A * 10/1983 Wawro et al. ..... 165/78
4,593,536 A * 6/1986 Fink et al. ..... 62/239
6,158,229 A * 12/2000 Aizawa ..... 62/77

* cited by examiner

*Primary Examiner*—Melvin Jones
(74) *Attorney, Agent, or Firm*—McKenna, Long & Aldridge, LLP

(57) ABSTRACT

Disclosed is an indoor unit for an air conditioner to improve convenience in carriage and installation. The indoor unit includes: a heat exchanger for performing heat exchange; a drain pan for draining condensed water generated while the heat exchanger operates; a connection tube formed at one side of the heat exchanger, for guiding flow of refrigerant; and a tube coupling part opened at both ends of the connection tube, for allowing the refrigerant to communicate with one of the both opened ends of the connection tube.

17 Claims, 12 Drawing Sheets

INDOOR UNIT FOR AIR CONDITIONER

BACKGROUND OF THE INVENTION

1. Field of the Invention

The present invention relates to an air conditioner, and more particularly, to an indoor unit for an air conditioner in which the indoor unit is installed standing on its head with ease. Further, this invention is directed to an indoor unit for an air conditioner in which drain problem of condensed water generated in the course of heat exchange in the indoor unit is solved to thereby enhance the use efficiency. Furthermore, this invention is directed to an indoor unit for an air conditioner in which convenience in carriage and installation is improved.

2. Description of the Related Art

In general, air conditioner is a cooling/heating apparatus installed in an indoor space such as office, home or the like, for cooling or heating the indoor space. Also, air conditioner is an apparatus for changing air status through a series of cooling cycle made by compressor, condenser, expander and evaporator.

The air conditioner includes an outdoor unit installed at an outdoor space and an indoor unit installed at an inner space of a building. The outdoor unit is provided with a condenser and a compressor, and the indoor unit is provided with an evaporator. Between the indoor unit and the outdoor unit, a refrigerant tube through which liquid or vapor refrigerant is circulated is installed.

The indoor unit is shaped in a rectangular bar and forms its appearance by a front panel, a side panel, a rear panel and an upper panel. A lower face of the indoor unit is opened to form a suction inlet and an upper surface of the indoor unit is penetrated to form an air outlet. In the meanwhile, a connection duct may be further installed in the suction inlet and the discharge outlet to connect the indoor unit with a space for air conditioning.

Inside the indoor unit is installed a barrier partitioning the inner space of the indoor unit into an upper portion and a lower portion. Below the barrier is installed a fan housing accommodating an indoor fan for generating a forced flow of air. Below the fan housing is installed an indoor heat exchanger. The indoor heat exchanger allows for heat exchange between refrigerant flowing through the refrigerant tube and air inflowed/outflowed by indoor fan. Below the indoor heat exchanger is installed a drain pan. The drain pan allows condensed water generated during an operation of the indoor heat exchanger to be collected and drained to the outside.

The drain pan is provided with a drain part protruded. The drain part is installed exposed to the outside and allows the condensed water staying in the drain pan to be drained to the outside. At the front panel, refrigerant tube through which refrigerant inflow or outflows and a plurality of penetration holes through which the drain part of the drain pan passes for connection with the exterior of the indoor unit are formed.

The conventional indoor unit has the following drawbacks. That is, when it is necessary to install the indoor unit in a standing state on its head depending on a change in the place where the indoor unit is mounted, and a change in the width and length of the place where the indoor unit is mounted, proper correspondence is impossible. In detail, when the inner door is mounted on the relatively high ceiling or the like in a standing state on its head, drain pan is positioned at the uppermost place of the indoor unit and indoor heat exchanger is positioned below the drain pan, which results in difficulty in collecting condensed water.

Also, in case the indoor unit is manufactured in a structure that allows only a standing installation on its head, it can be used only upon the standing installation on its head. Accordingly, a user fails to selectively install the indoor unit in a standing state on its head or a standing straight state. The drain problem of the condensed water occurs identically even in a lying installation as well as in the standing straight installation and the standing installation on its head.

Finally, due to this necessity, it is strongly required to provide a construction allowing the installation of the indoor unit in a desired direction. Especially, upon considering a tendency that the indoor space is narrowed and used densely in recent years, it is a strongly requested function to enable various alterations of the installation position of the indoor unit.

SUMMARY OF THE INVENTION

Accordingly, the present invention is directed to an indoor unit for an air conditioner that substantially obviates one or more problems due to limitations and disadvantages of the related art.

It is an object of the present invention to provide an indoor unit for an air conditioner in which it is allowed to alter the installation state of the indoor heat exchanger and the drain pan as necessary so that the installation direction of the indoor unit can be simply changed by a user.

It is another object of the present invention to provide an indoor unit for an air conditioner in which when the installation direction of the indoor unit is changed, condensed water can be rapidly drained regardless of the moving direction of the condensed water due to gravity. In other words, like when the indoor unit is installed in a straight standing state, a standing state on its head, or a lying state, although the indoor unit is installed in any direction, the indoor unit allows the condensed water essentially generated during operation of the indoor heat exchanger to be completely drained to the outside, thereby capable of actively responding to consumer's taste.

It is a further object to provide an indoor unit for an air conditioner that can be conveniently installed without any limitation on space and be also transferred conveniently.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an indoor unit for an air conditioner, comprising: a heat exchanger for performing heat exchange; a drain pan for draining condensed water generated while the heat exchanger operates; a connection tube formed at one side of the heat exchanger, for guiding flow of refrigerant; and a tube coupling part opened at both ends of the connection tube, for allowing the refrigerant to communicate with one of the both opened ends of the connection tube.

In an aspect of the present invention, there is provided an indoor unit for an air conditioner, comprising: a heat exchanger for performing heat exchange; a drain pan for draining condensed water generated while the heat exchanger operates; a connection tube formed at one side of the heat exchanger, for guiding flow of refrigerant; a tube coupling part opened at both ends of the connection tube, for allowing the refrigerant to communicate with one of the both opened ends of the connection tube; and a front panel provided with a tube hole at a position corresponding to the tube coupling part.

In another aspect of the present invention, there is provided an indoor unit for an air conditioner, comprising: a heat exchanger for performing heat exchange; a blower part for forcibly blowing air; a drain pan for draining condensed water generated while the heat exchanger operates; a connection tube formed at one side of the heat exchanger, for guiding flow of refrigerant; and a tube coupling part opened at both ends of the connection tube, for allowing the refrigerant to communicate with one of the both opened ends of the connection tube.

According to the present invention, freedom on installation of indoor unit is enhanced, users' convenience is improved, and installation space of indoor unit can be effectively used. Also, the air conditioner can be installed according to a user's desired state.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. It will be apparent to those skilled in the art that various modifications and variations can be made in the present invention. Thus, it is intended that the present invention covers the modifications and variations of this invention provided they come within the scope of the appended claims and their equivalents.

First Embodiment

FIGS. 1 to 9 illustrate a first embodiment of the present invention.

Figure 1:
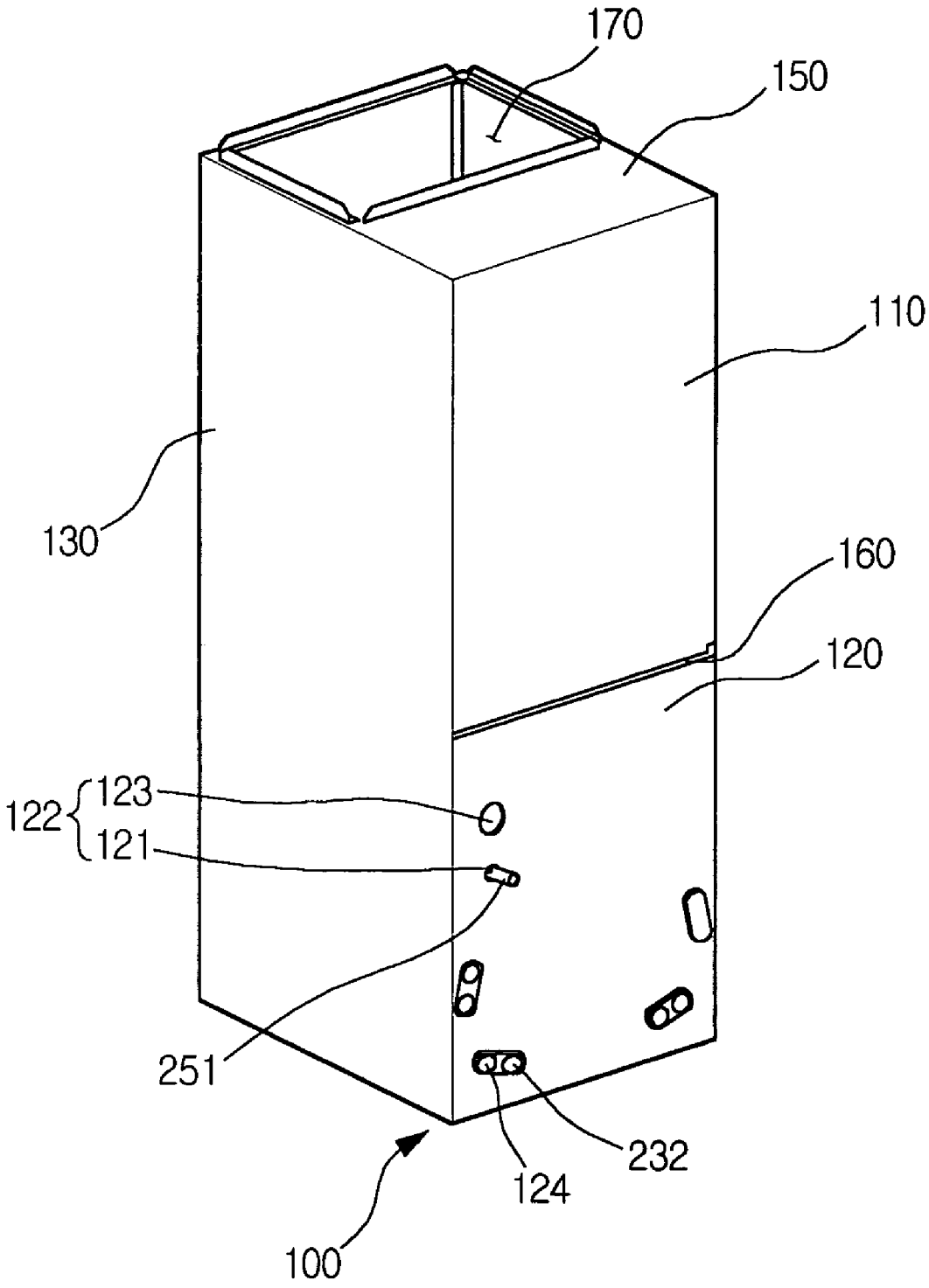
FIG. 1 is a perspective view illustrating an appearance of an indoor unit for an air conditioner according to a preferred embodiment of the present invention.
Figure 2:
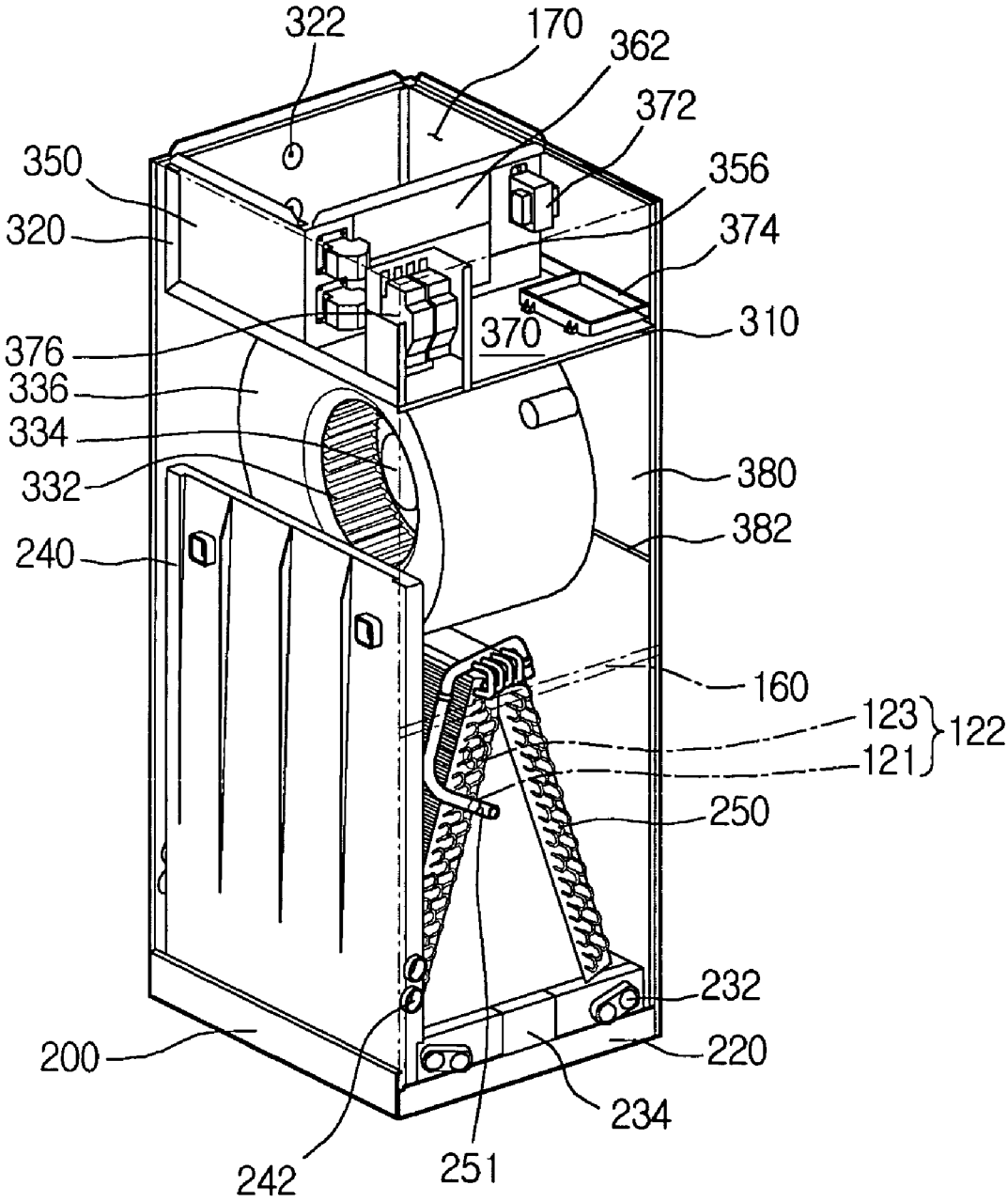
FIG. 2 is an inner perspective view of an indoor unit for an air conditioner for an air conditioner according to a first embodiment of the present invention.
Figure 3:
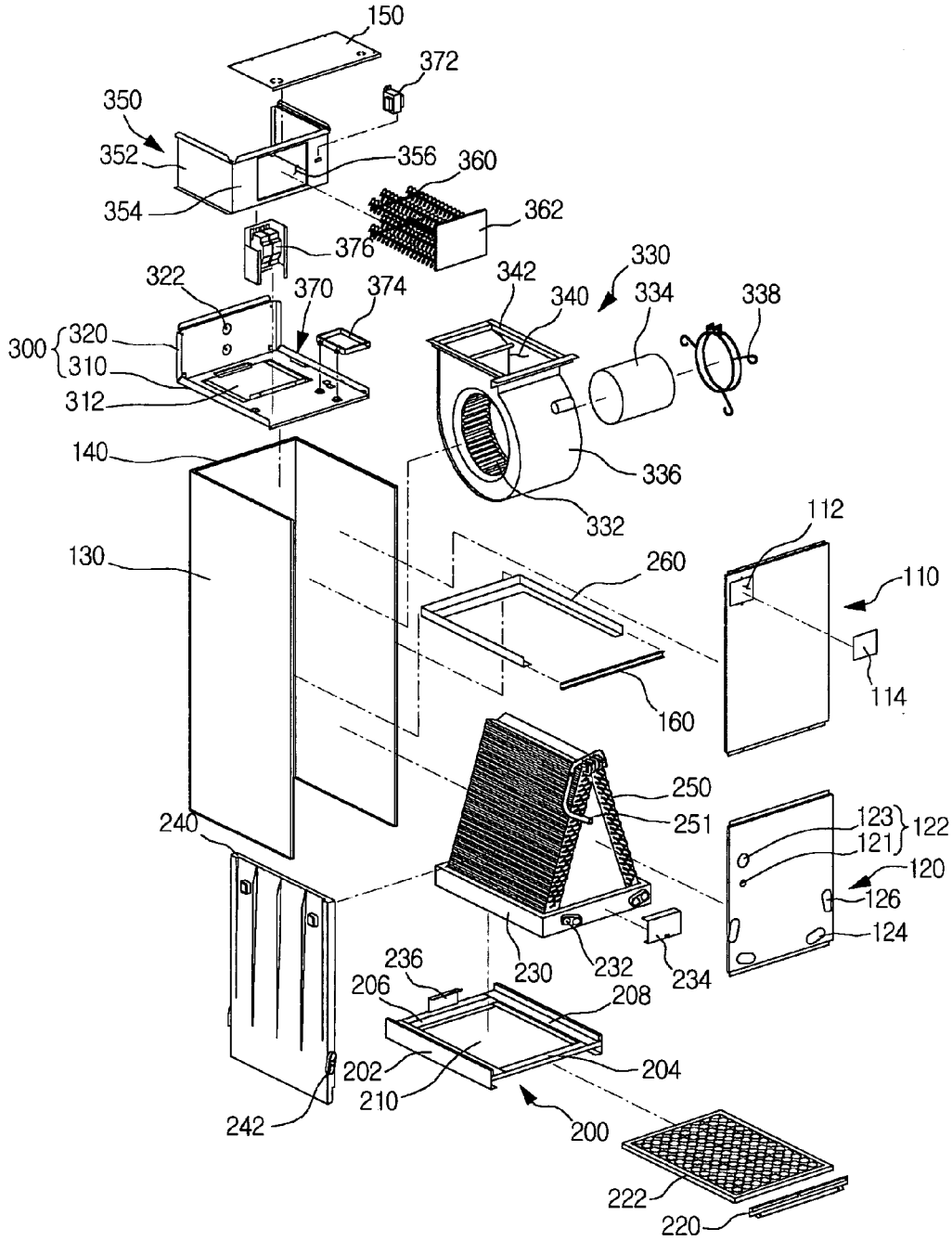
FIG. 3 is a disassembled perspective view of an indoor unit for an air conditioner according to a first embodiment of the present invention.
Figure 4:
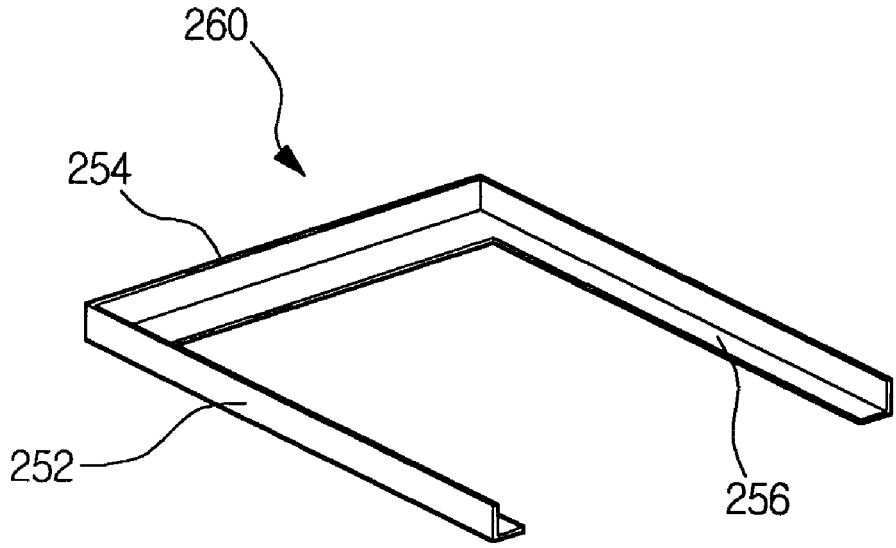
FIG. 4 is a perspective view of a middle frame in an indoor unit for an air conditioner according to a first embodiment of the present invention.
Figure 5:
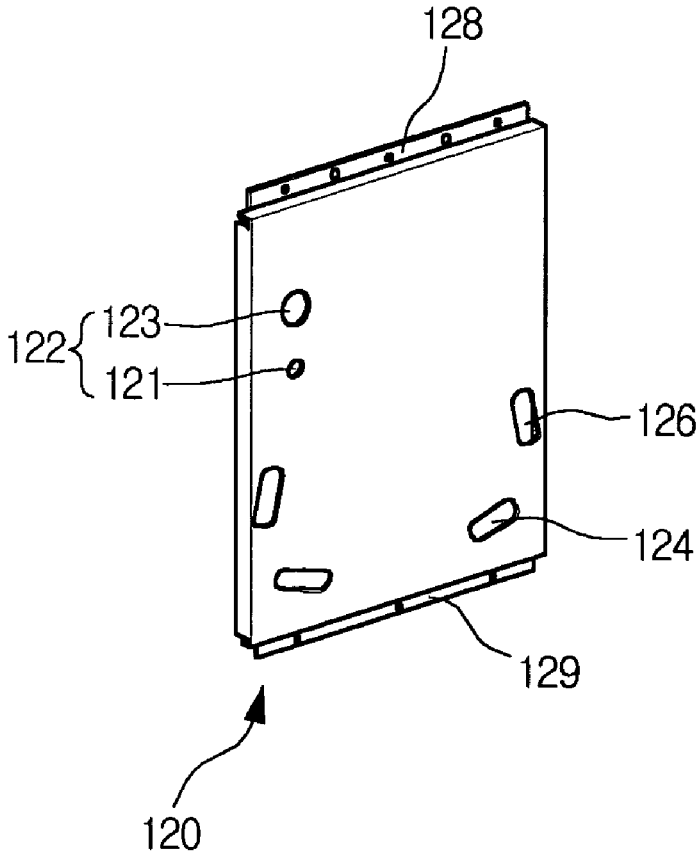
FIG. 5 is a perspective view of a front lower panel in an indoor unit for an air conditioner according to a first embodiment of the present invention.

FIG. 1 is a perspective view illustrating an appearance of an indoor unit for an air conditioner according to a preferred embodiment of the present invention, FIG. 2 is an inner perspective view of an indoor unit for an air conditioner for an air conditioner according to an embodiment of the present invention, and FIG. 3 is a disassembled perspective view of an indoor unit for an air conditioner according to the present invention.

Referring to FIGS. 1 to 3, an indoor unit 100 is approximately shaped in a rectangular box, and generally includes a cabinet part forming appearance of the indoor unit 100, a heat exchange part for performing heat exchange, a condensed water flow passage guide part through which condensed water is drained, a blower part for forcibly blowing air, and an electronic equipment part in which electronic parts are installed.

In detail, the cabinet part is configured to include front panels 110, 120 forming a front appearance of the indoor unit 100, side panels 130 forming a side appearance, a rear panel 140 forming a rear appearance, an upper panel 150 forming an upper appearance, and a lower frame 200, thereby forming an entire appearance of the indoor unit 100. The front panels 110 and 120 are divided into an upper portion and a lower portion, and consists of a front upper panel 110 placed at an upper side and a front lower panel 120 disposed below the front upper panel 110. A panel holder 160 is interposed between the front upper panel 110 and the front lower panel to closely contact the lower end of the front upper panel 110 and the upper end of the front lower panel 120 to the side panel 130. Alternatively, the side panel 130 and the rear panel 140 may be formed in an integral type so as to save the manufacturing costs.

In detail, at an upper left side of the front upper panel, a switch exposing hole 112 is formed. The switch exposing hole 112 is approximately shaped in a rectangle and configured to expose a power switch 376 to the outside. Also, the switch exposing hole 112 can be closed by a shielding plate 114 having a corresponding size to the switch exposing hole 112 when the air conditioner is not used.

In detail, the front lower panel is provided at left and right sides thereof with tube holes 122 through which a refrigerant tube communicating with an indoor heat exchanger 250 is penetrated. Each of the tube holes 122 consists of a high pressure tube hole 121 through which a high pressure tube for flow of refrigerant with a higher pressure is penetrated, and a low pressure tube hole 123 through which a low pressure tube for flow of refrigerant with a lower pressure is penetrated. A drain hole 124 through which a drain part 232 of a drain pan 230 is exposed to is also formed in the front lower panel 120. Further, a side drain hole 126 through which a side drain part 242 of a side drain pan 240 is exposed to, is formed above the drain hole 124.

In detail, at upper and lower ends of the front lower panel 120, bent ends 128 and 129 are formed symmetric with each other. In other words, an upper end of the front lower panel 120 is first bent reward by a predetermined portion and then again bent upward to form the upper bent end 128, and a lower end of the front lower panel 120 is first bent reward by a predetermined portion and then again bent to form the lower bent end 129. Thus, since the front lower panel 120 is constructed such that their upper and lower ends are symmetric with each other, it can be assembled with surrounding parts with ease even when the indoor unit is installed in a standing state on its head. The shape of the front lower panel 120 can be apparently understood by the perspective view of the front lower panel shown in FIG. 5.

In detail, the upper panel 150 forms the appearance of a front half of an upper face of the indoor unit 100. The remaining rear half of the upper face of the upper panel 150 is opened to form a discharge outlet 170. Indoor air of the indoor unit is discharged to the outside through the discharge outlet 170.

In detail, at a lower side of the side panel 130, a lower frame 200 is formed. The lower frame 200 includes a side frame part 202 extending in a front and rear direction and fixed to the lower side of the side panel 130, a front end frame part 204 connecting the front ends of the side frame parts 202, and a rear frame part 206 connecting the rear ends of the side frame parts 202. At an inner space of the lower frame 200 defined by the frame parts 202, 204 and 206, a rectangular suction inlet 210 is formed to guide air inflowed from the outside to the inside of the indoor unit 100. Also, at an upper end portion of the side frame part 202, a pan sliding part 208 protruded in a side direction is further formed. In other words, the pan sliding part 208 is protruded inwardly from the side frame part 202 by a predetermined length and extended in the front and rear direction. The drain pan 230 and the indoor heat exchanger 250 are supported on an upper surface of the pan sliding part 208, and the drain pan 230 is placed on the pan sliding part 208 and is slidable in the front and rear direction. Also, a filter cover 220 is formed on a front surface of the lower frame 200, and a rectangular air filter 222 is fixed to a rear surface of the filter cover 220. Accordingly, if the filter cover 220 is coupled to the front surface of the lower frame 200, the air filter 222 shields the suction inlet 210 so that foreign particles inflowed from the outside are filtered.

Next, construction of the condensed water flow passage guide will be described. On the lower frame, the drain pan 230 is mounted. The drain pan 230 is a portion to collect and drain condensed water generated in the indoor heat exchanger 250. At a front portion of the drain pan 230, a drain part 232 guides the condensed water staying in the drain pan 230 to be drained to the front side. The drain part 232 is exposed to the outside through the drain hole 124 of the front lower panel 120 and guides the drain of condensed water. In the meanwhile, it is desirable that the bottom of the drain pan 230 is partially inclined such that the condensed water staying in the bottom naturally flows to the front end. Also, the drain pan 230 is further provided at the front end and the rear end thereof with a pan fixing member 234, 236 to fix the drain pan 230 to the lower frame 200. In detail, the drain pan 230 is detachably provided at the front end thereof with the front end fixing member 234 to couple the front end of the drain pan 30 with the front frame part 204. Also, the drain pan 230 is detachably provided at the rear end thereof with the rear end fixing member 236 to couple the rear end of the drain pan 30 with the rear frame part 206. The rear end fixing member 236 can be molded integrally with the rear frame part 206.

Also, a side drain pan 240 is further provided on a left side edge of the drain pan 230. The side drain pan 240 is formed at a height corresponding to a height of the indoor heat exchanger 250 to function to collect condensed water dropping from the indoor heat exchanger 250 by gravity when the indoor unit 100 is installed in a building in a standing state on its head. A side drain part 242 is formed protruded toward the front direction at a lower portion of the side drain pan 240. The side drain part 242 guides the condensed water staying in the side drain pan 240 to be drained to the front side through the side drain hole 126 of the front lower panel 120. The side drain pan 240 can be installed at a right side of the indoor unit not at the left side of the indoor unit, or be installed at both sides of the indoor unit.

Next, construction of the heat exchanger will be described. The indoor heat exchanger 250 is mounted on and integrally with the drain pan 230. The indoor heat exchanger 250 cause heat exchange between refrigerant flowing through the heat exchanger and exterior air, and is constructed in a shape of 'Λ'. The front surface and rear surface of the indoor heat exchanger 250 is shielded to cut off air inflow. The indoor heat exchanger 250 is connected with a refrigerant tube so that expanded refrigerant is inflowed and is then evaporated to cool the surrounding air.

In the meanwhile, a middle frame 260 is installed at a rear side of the panel holder 160. The middle frame 260 includes a side part 252 fixed to the side panel 130, and a rear part 254 fixed to the rear panel 140. On an inner side surface of the middle frame 260, a pan guide 256 is protruded to support the drain pan 230. In detail, when the indoor unit 100 is installed in a standing state on its head, the indoor heat exchanger 250 and the drain pan 230 are placed on the upper side surfaces of the middle frame 260. At this time, the pan guide 256 inwardly protruded from the middle frame 260 by a predetermined width supports the lower surface of the drain pan 230. The middle frame 260 is to guide the position and the installation structure of the indoor heat exchanger 250 when the inventive indoor unit is installed in a standing state on its head. The shape of the middle frame 260 can be apparently understood by the perspective view of the middle frame shown in FIG. 4.

Next, construction of the blower part will be described in detail. The upper frame 300 is installed over and apart by a predetermined distance from the middle frame 260. The upper frame 300 includes a barrier 310 for partitioning an inner space into an upper portion and a lower portion, and a vertical guide part 320 vertically bent upward from a rear end of the barrier 310 and extended. The barrier 310 has a discharge hole 312 for guiding discharge of air forcibly blown from an indoor fan 332 to be described below. A housing assembly 330 is installed below the barrier 310. The housing assembly 330 includes an indoor fan 332 for generating air flow, a fan motor for supplying the indoor fan 332 with a rotational power, and a fan housing 336 for housing the indoor fan 332.

In detail, the fan motor 334 includes a motor mount 338 for the installation of the fan motor on an outer circumference thereof. At an upper end of the fan housing 336, a discharge hole 340 serving as an outlet of air discharged by the indoor fan 332 is formed. Also, along an edge of the discharge hole 340, a housing installation guiding part 342 is further formed. The housing installation guiding part 342 is protruded by a predetermined width outwardly from the edge of the discharge hole 340, and allows the fan housing 336 to be coupled to the barrier 310 by a front and rear sliding operation thereof with a housing installation part (not shown) formed at a lower surface of the barrier 410. As the fan motor 334 operates, the indoor fan 332 rotates so that forcible flow of air may be generated.

In detail, the vertical guide part 320 is formed at a predetermined height corresponding to a height of a discharge guide member 350 to guide air discharged through the discharge hole 312 upward. The vertical guide part 320 includes a heater installation groove 322, which is recessed in a rear direction, for latching a rear end of an electric heater 360. The discharge guide member 350 is to guide air forcibly blown by the indoor fan 332 upward, and includes a side plate 352 and a front plate 354, and is mounted on the discharge hole 312 of the barrier 310. The front plate 354 of the discharge guide member 350 includes a heater installation hole 356 through which the electric heater 360 penetrates. The electric heater 360 generates heat using a power supplied from an exterior to raise air temperature, and is installed inside the discharge guide member 350. In other words, the electric heater 360 is installed inside the discharge outlet 170 formed by the discharge guide member 350 and the vertical guide part 320 to heat air discharged by the indoor fan 332.

A heater support plate 362 is formed at a front end of and integrally with the electric heater 360. Accordingly, when the heater support plate 362 is fixed to the front plate 354 of the discharge guide member 350 and the rear end of the electric heater 360 is received in the heater installation groove 322 formed on the vertical guide part 320, the installation of the electric heater 360 is completed. The electric heater 360 can be installed selectively depending on a user desire. In case that the electric heater 360 is not installed, the heater installation hole 356 of the discharge guide member 350 can be shielded by a separate shielding plate (not shown).

Next, construction of the electric equipment part will be described in detail. A control box 370 is formed in front of the discharge guide member 350. The control box 370 is provided with a plurality of control parts for controlling the operation of the air conditioner, such as a power transformer 372 or a board 374. A power switch 376 is installed at a left front end of the control box 370. The power switch 376 is exposed to the outside through the switch exposing hole 112. The upper face of the control box 370 is shielded by the upper panel 150.

In the meanwhile, a connection duct (not shown) may be further installed at the suction inlet 210 and the discharge outlet 170. In other words, when the indoor unit 100 is not directly in contact with an indoor space for air conditioning but is installed in a warehouse or the like by a separate part, the connection ducts (not shown) connecting the indoor unit 100 with an air conditioning inner space can be connected respectively to the suction inlet 210 and the discharge outlet 170.

Also, inside an appearance case such as the side panel 130 or the rear panel 140, an adiabatic member 380 for shielding heat from an exterior may be further provided. In case the adiabatic member 380 is further installed, an adiabatic member fixing guide 382 for closing contacting the adiabatic member 380 with an inner surface of the panels 130, 140 may be further installed at a center portion.

Hereinafter, operation and interaction of the indoor unit for an air conditioner with the aforementioned construction will be described.

Figure 6:
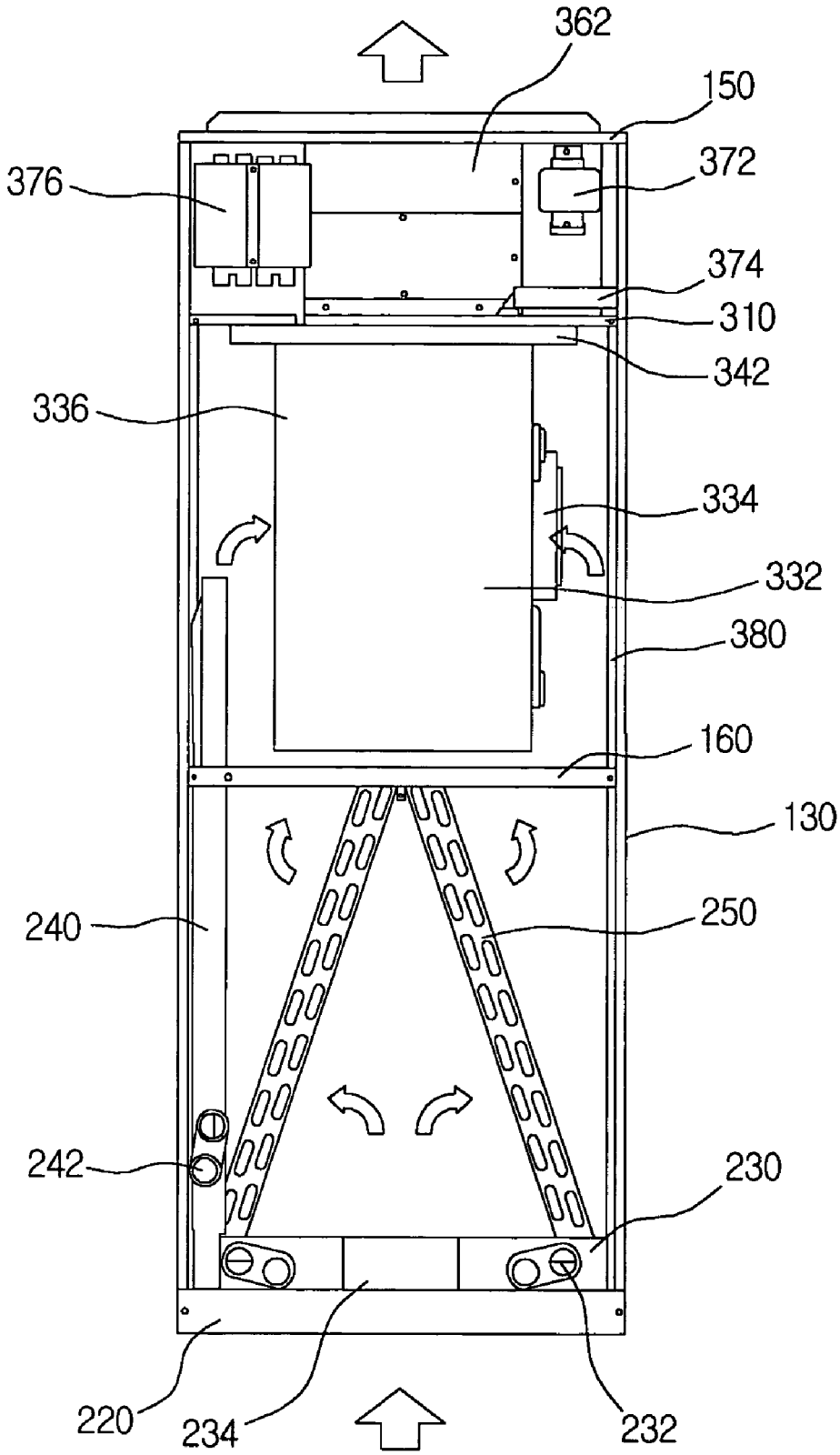
FIG. 6 illustrate that an indoor unit for an air conditioner according to a first embodiment of the present invention is used in a straight standing state.
Figure 7:
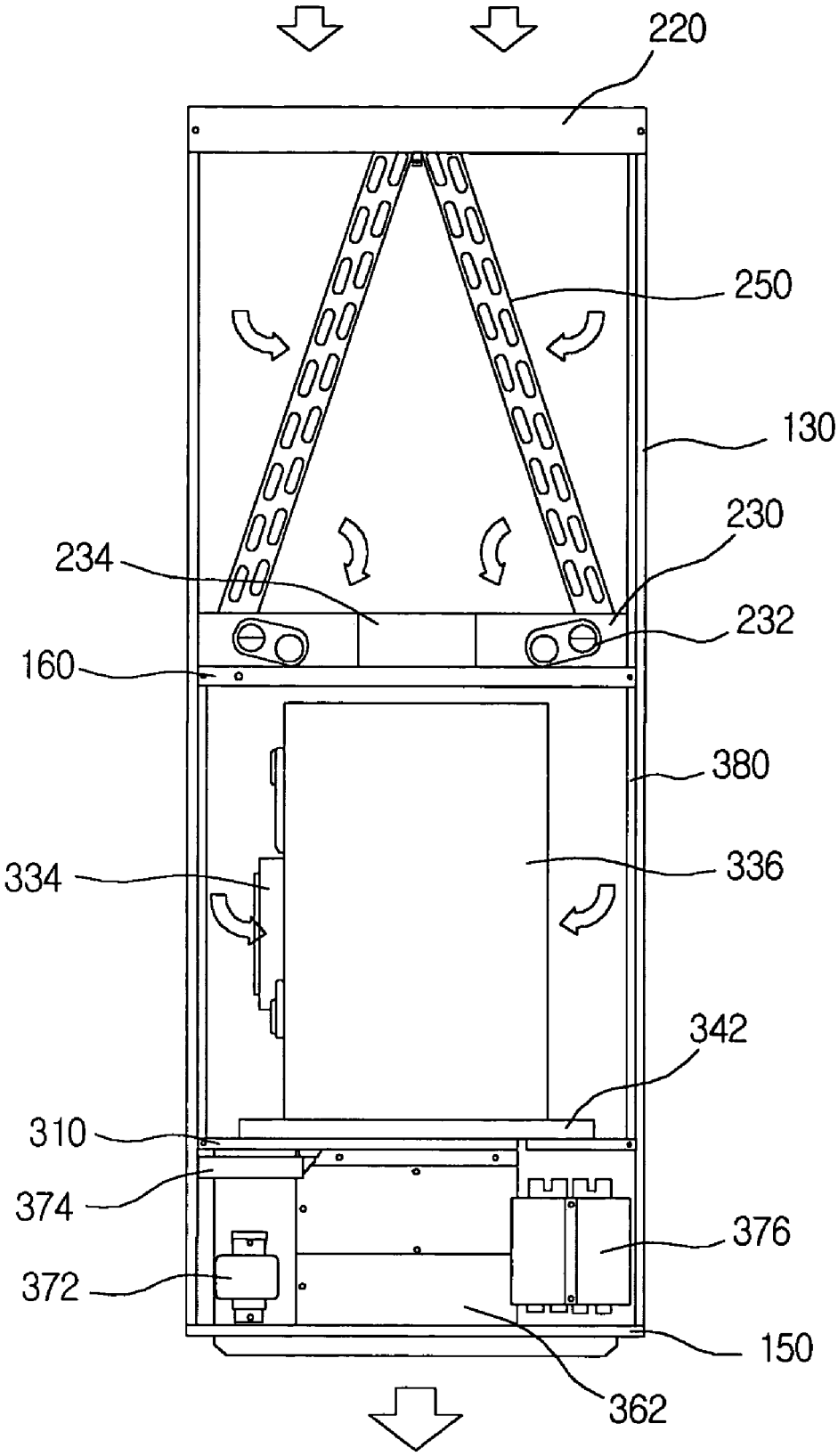
FIG. 7 illustrate that an indoor unit for an air conditioner according to a first embodiment of the present invention is used in a standing state on its head.

FIG. 6 illustrate that an indoor unit for an air conditioner according to the present invention is used in a straight standing state, and FIG. 7 illustrate that an indoor unit for an air conditioner according to the present invention is used in a standing state on its head.

Referring to FIGS. 6 and 7, the indoor unit of the present invention is used in a straight standing state as shown in FIG. 6. At this time, air is inflowed into the inside of the indoor unit 100 through the suction inlet 210 from a lower direction, and is discharged through the discharge outlet 170 formed at an upper side surface after air conditioning operation is completed.

In detail, if the indoor fan 322 is rotated by a power applied from an exterior, a suction power is generated and thereby external air is inhaled into the indoor unit 100 through the suction inlet 210. Foreign particles contained in the air inflowed into the indoor unit 100 through the suction inlet 210 are filtered through the air filter (see numeral 222 of FIG. 3) and the filtered air exchanges heat while passing through the heat exchanger 250. In other words, when the air conditioner according to the present invention operates in a cooling mode, the indoor heat exchanger 250 functions as an evaporator so that heat of the air inhaled through the suction inlet 210 is taken away from refrigerant flowing through the indoor heat exchanger 250. Of course, if the indoor heat exchanger 250 is used as a condenser, inhaled air may be heated.

In the meanwhile, when heat is exchanged through the indoor heat exchanger 250, a difference in temperature causes condensed water to be generated in the indoor heat exchanger 250. The generated condensed water flows down due to gravity and is collected in the drain pan 230. The condensed water dropped in the drain pan 230 is transferred to the front end thereof and is then drained to an exterior of the indoor unit 100 through the drain part 232.

The air whose heat is taken away while passing through the indoor heat exchanger 250 is introduced into the indoor fan 332 through a side direction of the fan housing 336, and is then discharged in a circumferential direction. The air discharged in the circumferential direction by the indoor fan 332 is guided by the fan housing 336 and is then discharged upward through the discharge hole 340. The air discharged through the discharge hole 340 of the fan housing 336 is discharged to an exterior through the discharge outlet 170 formed by the discharge guide member 350 and the vertical guide part 320 of the upper frame 300. Of course, although not shown in the drawings, a separate connection duct may be further installed between the discharge outlet 170 and an air conditioning space to guide air.

Also, although not shown in the drawings, while the indoor unit 100 is operated as above, an outdoor heat exchanger of an outdoor unit installed at a separate space functions as a condenser. Accordingly, since the refrigerant inside the outdoor heat exchanger discharges heat to the atmosphere, parts of the indoor unit 100 and the outdoor unit form a cycle.

Next, there will be described a case where the indoor unit 100 is used as a heat pump for heating. At this time, the flow direction of the refrigerant (working fluid) flowing through the indoor heat exchanger 250 is changed to an opposite direction, thereby allowing the indoor heat exchanger 250 to function as an condenser, or the electric heater 360 is operated to heat air with ease. Since the operation of the indoor heat exchanger 250 as a heat pump is possible only if the flow direction of refrigerant is made in an opposite direction, their detailed description is omitted and heating using the electric heater 360 will be described.

Exterior air (air conditioning space) is inflowed into the indoor unit 100 through the suction hole 210 by rotation of the indoor fan 332, and then passes through the indoor heat exchanger 250. At this time, since the indoor heat exchanger 250 is in a non-operation state, heat is not exchanged so that inhaled air moves upward, and is inflowed into the indoor fan 332 through the side direction of the fan housing 336. Air forcibly blown by the indoor fan 332 is guided upward by the fan housing 336 to pass through the inside of the discharge guide member 350.

At this time, since the electric heater 360 is heated by an external power, the air passing through the discharge guide member 350 is heated by the electric heater so that the hot air is discharged to the indoor space through the discharge outlet 170. As a result, heating of the indoor space is realized. Especially, the electric heater 360 can be used in convenience in an initial operation stage that requests a rapid heating.

In the meanwhile, the indoor unit constructed as above may be installed in a standing state on its head if necessary. In case the indoor unit is installed in a standing state on its head, it is necessary to change the installation state of the indoor heat exchanger 250 and the drain pan 230 as shown in FIG. 7 so as to process the condensed water generated in the indoor heat exchanger 250.

In detail, as shown in FIG. 7, after the indoor heat exchanger 250 and the drain pan 230 that are installed at the lower side of the indoor unit 100 are drawn forward and separated, the indoor unit 100 is stood on its head, and the indoor heat exchanger 250 and the drain pan 230 are mounted on the middle frame 260. The front lower panel 120 is also separated and is installed standing on its head like the indoor heat exchanger 250. By doing so, the drain part 232 of the drain pan 230 is exposed to an exterior through the drain hole 124 of the front lower panel 120 like the case where the indoor unit 100 stands straight.

In the meanwhile, as aforementioned, in case the drain pan 230 and the indoor heat exchanger 250 are mounted on the middle frame 260, the rear end of the drain pan 230 is placed on the front end of the middle frame 260 and the drain pan 230 is pushed rearward so that both ends of the drain pan 230 are slid with placed on the upper surface of the pan guide 256, pushed rearward and equipped.

Figure 8:
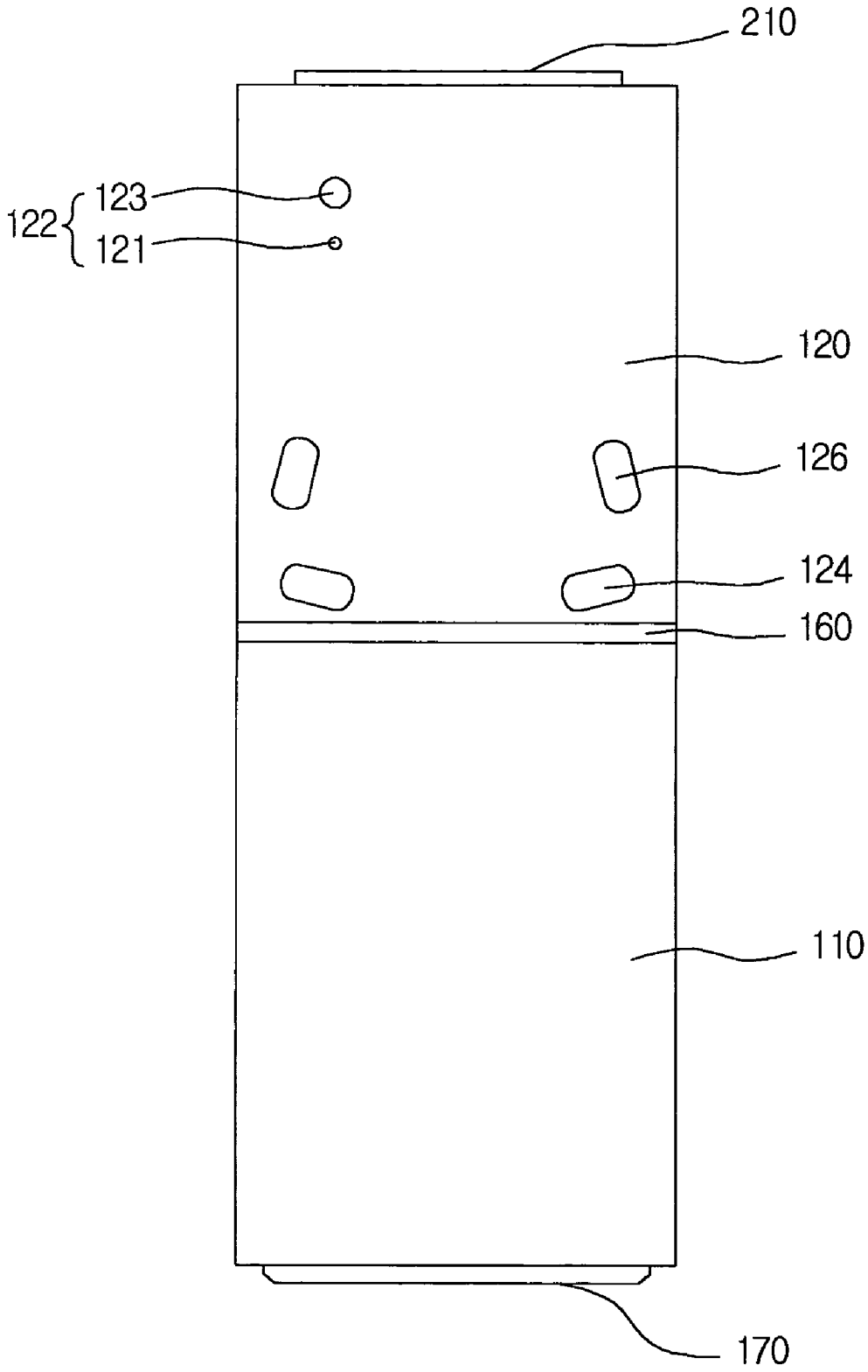
FIG. 8 illustrates a state of a front panel when an indoor unit for an air conditioner according to a first embodiment of the present invention is used in a standing state on its head.

Thus, in a state where the indoor heat exchanger 250 and the drain pan 230 are installed standing on their heads, a state of the front panel 110, 120 is illustrated in a front view of FIG. 8.

Reviewing the operation state in this state, the indoor fan 322 is first rotated by application of an external power like the straight standing installation.

As the indoor fan 332 rotates, external air is inhaled from an upper side into the indoor unit 100. The air inhaled through the suction hole 210 exchanges heat with inner refrigerant while passing through the indoor heat exchanger 250 so that it is changed to cool air.

At this time, condensed water is generated on the surface of the indoor heat exchanger 250 in the course of heat exchange, and the generated condensed water is collected in the drain pan 230 formed below and integrally with the indoor heat exchanger 250. Accordingly, the condensed water staying in the drain pan 230 can be drained to the outside through the drain part 232 formed at the front end thereof.

Also, the air passing through the indoor heat exchanger 250 is moved downward and introduced into the inside of the indoor fan 332 through the side portion of the fan housing 336. The air introduced into the inside of the indoor fan 332 is discharged in a circumferential direction and exhausted downward through the discharge outlet 170. A connection duct (not shown) may be further installed in the discharge outlet 170. This connection duct may guide the air discharged through the discharge outlet 170 to an air conditioning space.

According to the proposed embodiment of the present invention, in any of cases where the indoor unit is installed in a straight standing state or in a standing state on its head, condensed water generated in the course of condensation of the heat exchanger can be drained to the outside conveniently. In other words, by the spirit of the present invention, since the drain pan is always positioned below the indoor heat exchanger, the condensed water dropped by gravity can be drained to the outside conveniently.

Second Embodiment

The second embodiment of the present invention is shown in FIGS. 9 to 16, and is the same in many parts as the first embodiment. It should be understood, however, that the second embodiment is characterized by removing limitations in installation of the by using a connection tube 251 connecting the indoor heat exchanger with the refrigerant tube. In the drawings, similar reference numerals denote similar elements.

In detail, in the first embodiment, since the connection tube 251 is fixed to a left side of the front end of the indoor heat exchanger 250, in case where the connection tube 251 is connected with the refrigerant tube, a limitation on installation is caused. In other words, it is possible to connect the refrigerant tube only through a left side of the front surface of the indoor unit. So, if an obstacle is in front of the left side, a difficulty on installation is caused. Also, the connection tube 251 is always protruded in a front direction of the front panel 120. Hence, when it is intended to move the indoor unit 100, a protection bracket should be installed to protect the connection tube 251.

In addition, since the connection tube 251 is protruded in a front direction of the front panel 120, the indoor unit may be damaged during its carriage. Also, when it is intended to concurrently carry several indoor units stacked, there occurs a drawback in that carrying capacity per unit area is reduced. Accordingly, the present embodiment is constructed so that the refrigerant tube connected with the outdoor unit can be selectively connected to a left side or a right side of a heat exchanger, thereby further enhancing convenience on installation of the indoor unit. Parts that are not described particularly in the present embodiment can employ the same constructions as those of the first embodiment without any modifications.

Figure 9:
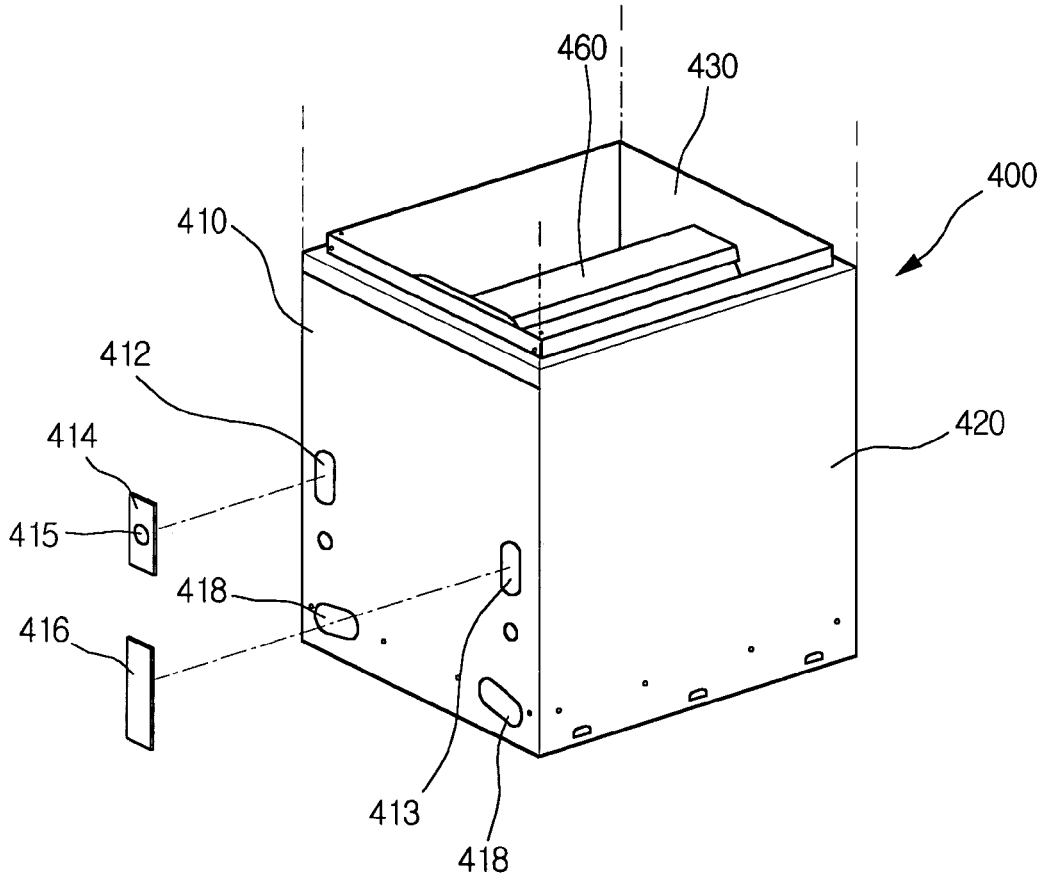
FIG. 9 is a perspective view of a lower part in an indoor unit for an air conditioner according to a second embodiment of the present invention.
Figure 10:
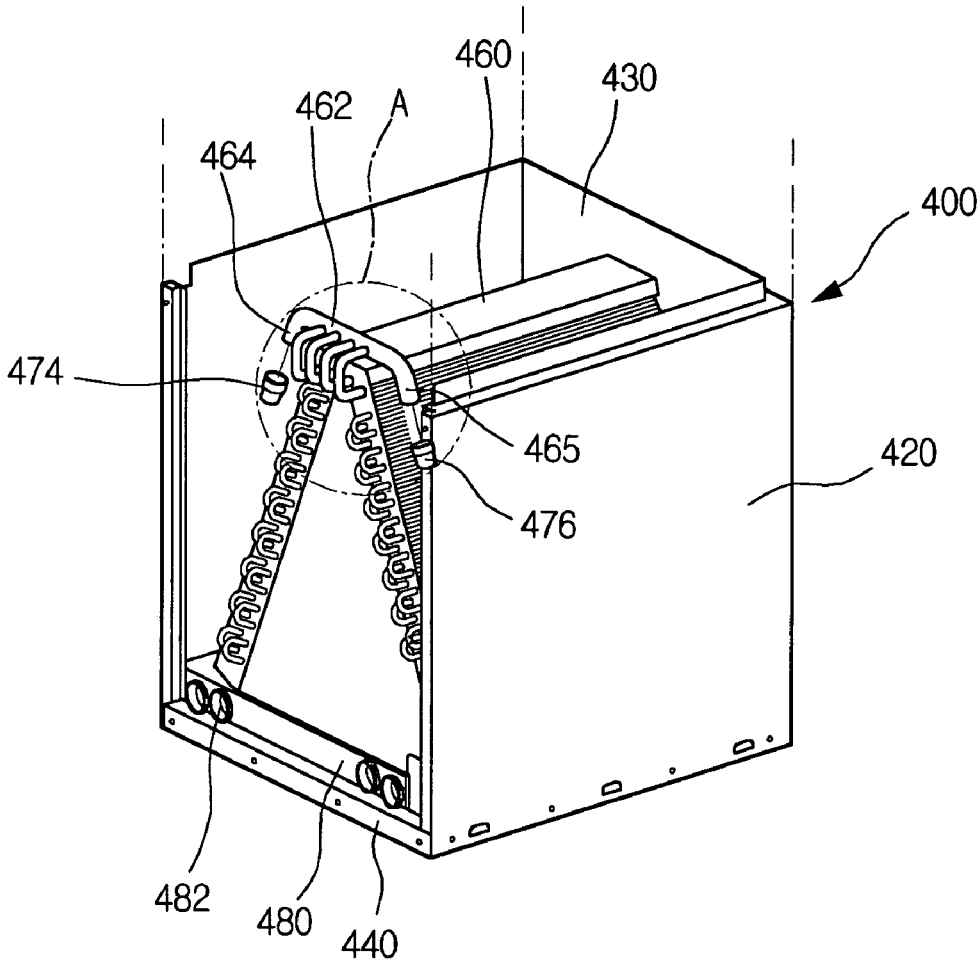
FIG. 10 is a perspective view illustrating an inner construction of a lower part in an indoor unit for an air conditioner according to a second embodiment of the present invention.
Figure 11:
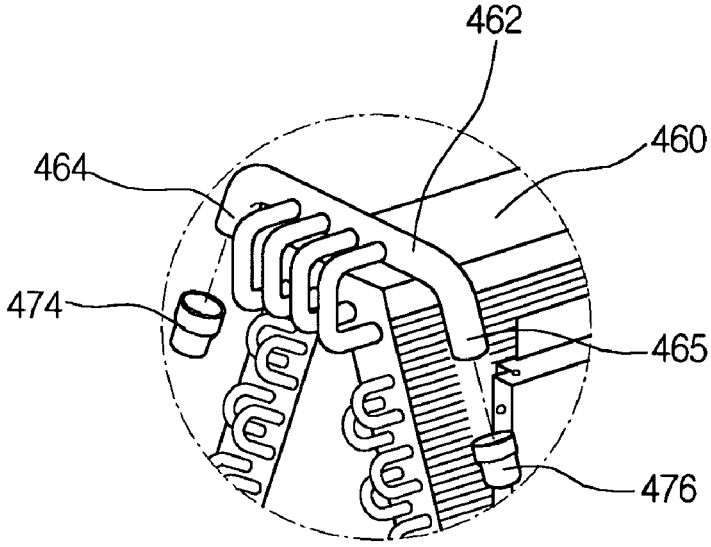
FIG. 11 is a detailed view of the portion 'A' of FIG. 10.
Figure 12:
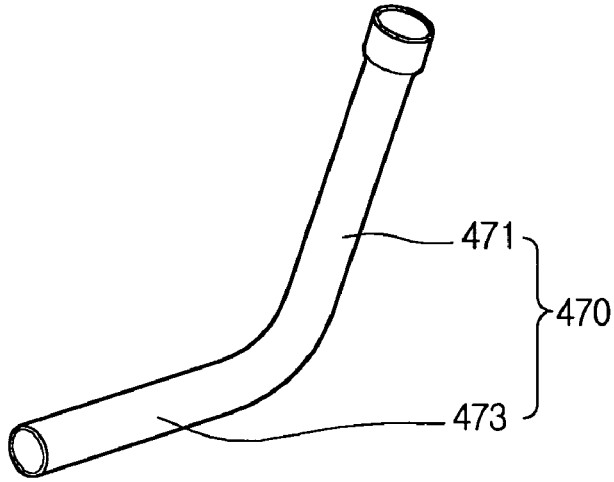
FIG. 12 is a perspective view of a flow passage guider.

FIG. 9 is a perspective view of a lower part in an indoor unit for an air conditioner according to a second embodiment of the present invention, FIG. 10 is a perspective view illustrating an inner construction of a lower part in an indoor unit for an air conditioner according to a second embodiment of the present invention, and FIG. 11 is a detailed view of the portion 'A' of FIG. 10.

Referring to FIGS. 9 to 11, an indoor unit 400 is approximately shaped in a rectangular box, and generally includes a front panel 410 forming a front appearance of the indoor unit 400, a side panel 420 forming a side appearance, a rear panel 430 forming a rear appearance, and a base frame 440 provided on a lower side to support inner parts.

In detail, at left and right sides of a middle portion of the front panel 410, tube holes 412, 413 are formed. The tube holes 412, 413 consist of a left tube hole 412 made in the left side and a right tube hole 413 made in the right side. These tube holes 412 and 413 are configured to have a left and right (horizontal) diameter corresponding to the diameter of a flow passage guider (see numeral 470 of FIG. 13) and a vertical diameter such that it can be installed regardless of the protruded position of the flow passage guider 470. In detail, the tube holes 412 and 413 are configured such that their vertical length is greater than their horizontal length. This is to, although the flow passage guider 470 has some difference in the front protrusion position in the vertical direction, allow the flow passage guider 470 to be protruded toward the front direction through the tube holes 412, 413.

In front of the left tube hole 412, a fixing plate 414 is installed. The fixing plate 414 fixes the flow passage guider 470 to be installed protrudedly toward the front direction. Accordingly, at a center portion of the fixing plate, a penetration hole 415 having a diameter corresponding to an outer diameter of the flow passage guider 470 is formed.

In front of the right tube hole 413, a shielding plate 416 is installed to shield the non-used right tube hole 413. Of course, in case the flow passage guider 470 is not installed in the left tube hole 412 but is installed forwardly protruded through the right tube hole 413, the left tube hole 412 would be shielded. Hereinafter, an example where the flow passage guider 470 is installed in the left tube hole 412 will be described.

At the lower right and left sides of the front panel 410, drain holes 418 are respectively formed. The drain holes 418 are to guide the drain part 482 of the drain pan 480 to be protruded forward.

Inside the indoor unit 400, an indoor heat exchanger 460 is installed. The indoor heat exchanger 460 is to exchange heat between refrigerant flowing through the heat exchanger 460 and air inhaled from an exterior, and is molded in a shape of 'Λ'.

At a front end of the heat exchanger 460, a connection tube 462 serving as inflow and outflow passage of refrigerant is provided. The connection tube 462 is formed at an upper front end of the heat exchanger 460 in a left and right direction. The left and right edges of the connection tube 462 are bent downward to form tube coupling parts 464, 465. In other words, at the left end of the connection tube 462, the left tube coupling part 464 is formed, and at the right end of the connection tube 462, the right tube coupling part 465 is formed. The flow passage guider 470 is selectively coupled to any one of the left and right coupling parts 464, 465. In other words, the flow passage guider 470 is coupled to the left tube coupling part 464 or the right tube coupling part 465 depending on a user's choice.

The flow passage guider 470 has a predetermined length, and its mid-portion is bent at a predetermined angle. The flow passage guider 470 has a coupling part 471 coupled with the tube coupling part 464 or 465, and a protruding part 473 protruded forwardly from the front panel 440, and is bent at a predetermined angle between the coupling part 471 and the protruding part 473. Accordingly, when the coupling part 471 of the flow passage guider 470 is coupled to the tube coupling part 464 or 465 of the connection tube 462, the opposite side of protruding part 473 is protruded in a front direction of the front panel 440. Referring to the perspective view of the flow passage guider shown in FIG. 12, the shape of the flow passage guider would be understood more apparently.

In the meanwhile, the flow passage guider 470 is coupled to the connection tube 462 after the indoor unit 400 is carried to an installation place. While the indoor unit 400 is carried, the flow passage guider 470 is in a separated state from the connection tube 462. Accordingly, the tube coupling parts 464 and 465 of the connection tube 462 are carried with being covered with a cap. In detail, the left tube coupling part 464 is arbitrarily covered with a protection cap 474. After carrying is completed, the protection cap 474 is removed from the left tube coupling part 464 and then the flow passage guider 470 is coupled to the left tube coupling part 464. Accordingly, it is desirable that the protection cap 474 is configured to be easily separated. The protection cap 474 is formed to have a shape easily assembled or disassembled through a mechanical processing such as foaming, pressing of one end portion or the like. Alternatively, the protection cap 474 can be fixed to the right tube coupling part 465 by a welding.

In the right tube coupling part 465 of the connection tube 462, a sealing cap 476 is installed. The sealing cap 476 seals the right tube coupling part 465 such that refrigerant flowing through the connection tube 462 is not leaked to the outside, and is preferably of the same material as the connection tube 462.

The flow passage guider 470 is coupled to the front end of the left tube coupling part 464 so that the protruding part 473 of the flow passage guider 470 is protruded toward a front direction of the front panel 410. Then, a refrigerant tube (not shown) is installed of which one end is connected to the protruding part 473 and the other end is connected to the outdoor unit so that refrigerant can be circulated.

Below the heat exchanger 460, a drain pan 480 is installed. The drain pan 480 is installed on the base frame 440 provided on the lower side of the indoor unit 400, and functions to collect and drain condensed water generated in the heat exchanger 460.

At the front left and right sides of the drain pan 480, drain parts are formed forward protruding from the front end of the drain pan 480. The drain parts 482 are installed exposed to the outside through the drain holes 418 of the front panel 410, and allows the condensed water staying in the drain pan 480 to be drained forward. A drain hose (not shown) may be further connected with the drain parts 482 to guide and drain condensed water to other place. The drain part 482 has been described through the first embodiment, and can quote from the description of the first embodiment.

Hereinafter, operation of the indoor unit for an air conditioner will be described.

Figure 13:
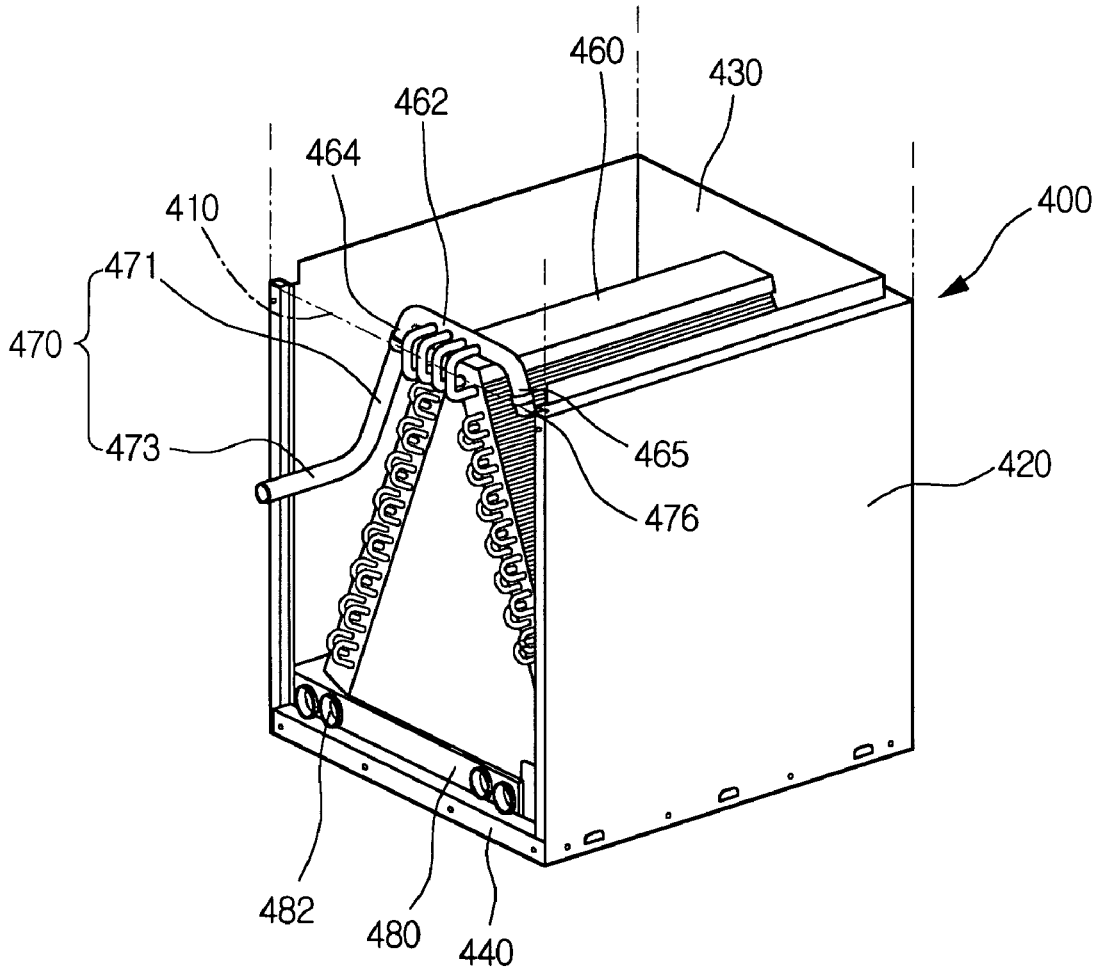
FIGS. 13 and 14 are outer and inner perspective views of a lower part in an indoor unit provided at a left side of a connection tube with a flow passage guide according to a second embodiment of the present invention.
Figure 14:
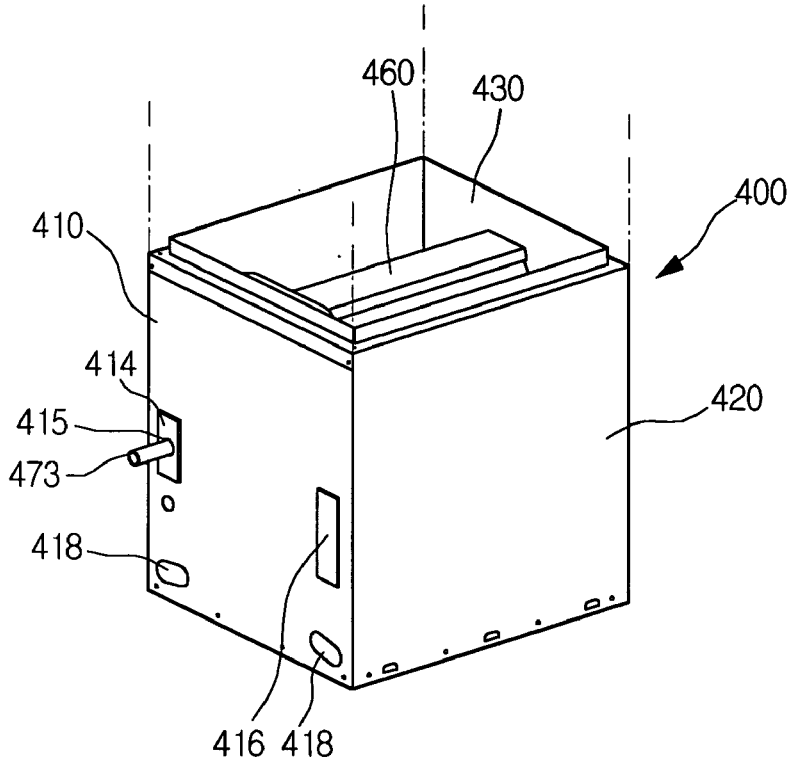
Figure 15:
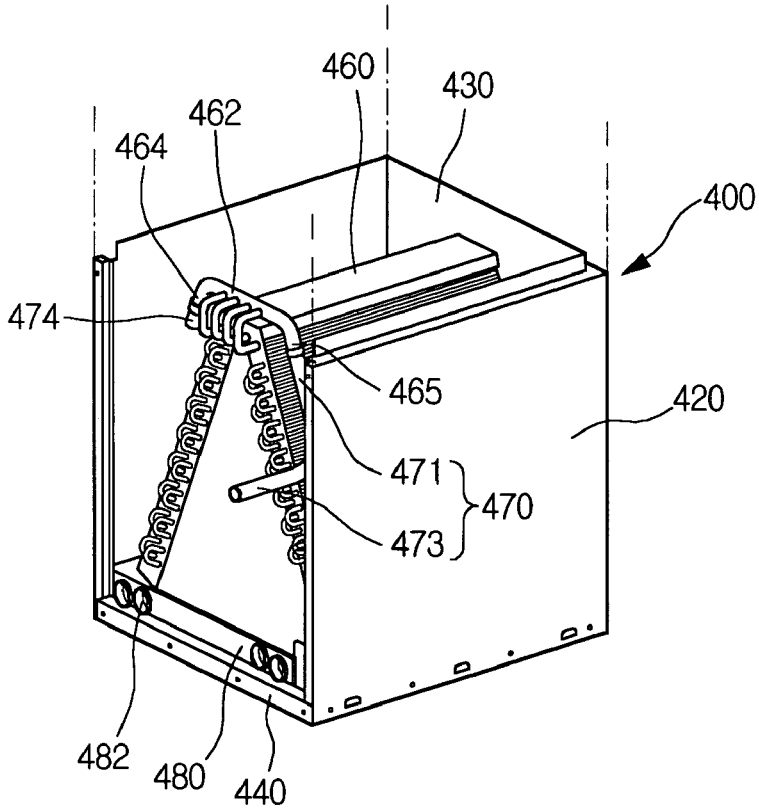
FIGS. 15 and 16 are inner and outer perspective views of a lower part in an indoor unit provided at a right side of a connection tube with a flow passage guide according to a second embodiment of the present invention.
Figure 16:
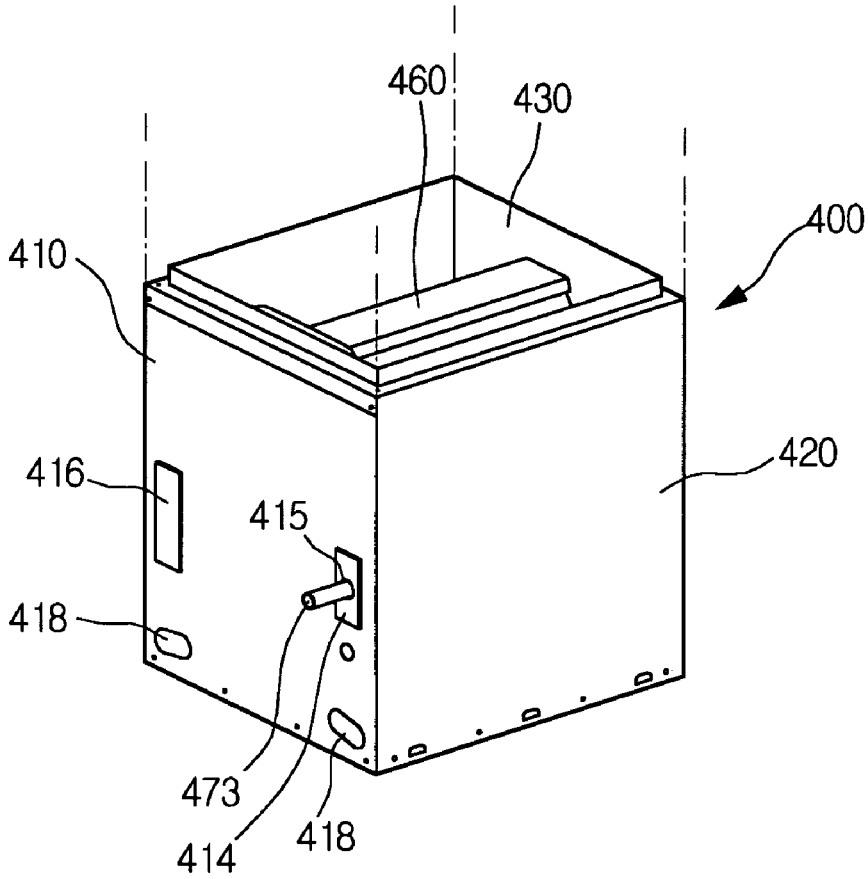

FIGS. 13 and 14 are outer and inner perspective views of a lower part in an indoor unit provided at a left side of a connection tube with a flow passage guide according to a second embodiment of the present invention, and FIGS. 15 and 16 are inner and outer perspective views of a lower part in an indoor unit provided at a right side of a connection tube with a flow passage guide according to a second embodiment of the present invention.

Referring to FIGS. 13 to 16, while the indoor unit 400 is carried, the both side ends of the connection tube 462 are respectively covered with the protection cap 474 and the sealing cap 476. In other words, the left tube coupling part 464 is covered with the protection cap 474 separable with ease, and the right tube coupling part 465 is sealed with the sealing cap 476 by a welding. At this time, if the front panel 410 is installed, the indoor unit 400 is, as shown in FIG. 10, in a state that the flow passage guider 470 is not protruded toward a front side of the front panel 410. Accordingly, it is easy to carry the indoor unit. The flow passage guider 470 is a separate part from the main body of the indoor unit and is carried in a separate state.

After the carriage of the indoor unit 400 is completed, the protection cap 474 inserted in the left tube coupling part 464 is removed and then the flow passage guider is coupled to the left tube coupling part 464. At this time, the protruding part 474 of the flow passage guider 470 is installed protruding forward. Since the right tube hole 413 is not used, it is in a shielded state by the shield plate.

By doing so, the appearance of the indoor unit 400 is in the state shown in FIGS. 13 and 15. A refrigerant tube (not shown) is coupled to the front end of the flow passage guider 470 to communicate with the outdoor unit (not shown).

FIGS. 15 and 16 illustrate that the flow passage guider 470 is coupled to the right tube coupling part 465 and is protruded to an exterior of the indoor unit 400 through the right tube hole 413. Of course, it can be guessed that the shield plate 416, the protection cap 474 and the sealing cap 476 would be fixed to symmetric positions with the positions in the case where the flow passage guider 470 is coupled to the left tube coupling part 464.

In the meanwhile, in the present embodiment, all constructions including indoor fan, electronic equipment and the like are integrated in the upper side of the indoor unit like those of first embodiment. It should be understood, however, that the aforementioned limitation is not essential. Alternatively, an indoor unit may be constructed such that the indoor fan and the electronic equipment part are not provided above the indoor heat exchanger 460. In other words, the indoor fan and the electronic equipment part are separate elements, and cannot be arranged on the same vertical line but be separately arranged on different places. Also, they may be not formed in the same cabinet part. By doing so, the indoor unit may be constructed such that blowing is performed at a separate place and air may forcibly flow through a duct.

In addition, it is possible that holes are formed at left and right sides of the front panel and a duct extends to the outside through the hole like the first embodiment.

By doing so, the indoor unit of the first embodiment can be provided therein with the same indoor heat exchanger as that in the second embodiment. In other words, it is possible to form an inlet for inhaling refrigerant from and an outlet for discharging refrigerant to the indoor heat exchanger at both the right and left sides.

According to the proposed embodiments, freedom on installation position of the indoor unit is further enhanced. In detail, even in case where an obstacle is in front of the indoor unit, it becomes possible to install the indoor unit by protruding the flow passage guider through any one of the left and right tube holes. Also, even when the indoor unit is installed in either a straight standing state or a standing state on its head, the indoor heat exchanger and the drain pan can be variably mounted on correct positions so that indoor installation of the air conditioner can be performed conveniently.

In addition, since users can mount or separate the drain pan conveniently in a sliding manner, users' convenience is further enhanced.

Further, since the structure of the front panel can be conveniently modified depending on whether the indoor unit is installed in a straight standing state or in a standing state on its head, users' convenience is further enhanced. Furthermore, since there is no need of additively forming a separate hole at a predetermined position of the front panel, man-power is reduced. Moreover, since the reduced number of drain holes allows the communication space between the inner space and the outer space of the indoor unit to be reduced, adiabatic effect is further improved and heat efficiency of the indoor unit is also enhanced.

Also, since the connection tube is not protruded forward from the front panel during carriage of the indoor unit, the connection tube is prevented from being fractured during carriage of the indoor unit. Also, when several indoor units are kept in a stack state, the number of the loaded indoor units is increased so that carriage and packing become easy.

What is claimed is:

1. An indoor unit for an air conditioner, comprising:
a heat exchanger for performing heat exchange:
a drain pan for draining condensed water generated while the heat exchanger operates;
a connection tube formed at one side of the heat exchanger, for guiding flow of, refrigerant, wherein
the connection tube has a tube coupling part at each end, for allowing the refrigerant to communicate with either end of the connection tube; and
a flow passage guider selectively fixable to either coupling part.

2. The indoor unit according to claim 1, wherein the tube coupling parts are positioned at left and right sides of the heat exchanger.

3. The indoor unit according to claim 1, wherein at least one the tube coupling parts comprise a sealing cap for closing the connection tube.

4. The indoor unit according to claim 1, further comprising a sealing cap fixed by a welding to sealingly close at least one of the tube coupling parts.

5. The indoor unit according to claim 1, wherein at least one of the tube coupling parts have one end protected by a protection cap.

6. The indoor unit according to claim 1, wherein the flow passage guider has one end coupled to one of the tube coupling parts and the other end exposed to an exterior through a cabinet part.

7. An indoor unit for an air conditioner, comprising:
a heat exchanger for performing heat exchange;
a drain pan for draining condensed water generated while the heat exchanger operates;
a connection tube formed at one side of the heat exchanger, for guiding flow of refrigerant, wherein the connection tube has a tube coupling part at each end, for allowing the refrigerant to communicate with either end of the connection tube;
a flow passage guider fixable to one of the tube coupling parts; and
a front panel provided with a tube hole at a position corresponding to the tube coupling part.

8. The indoor unit according to claim 7, wherein the flow passage guider is selectively fixable to either tube coupling part.

9. The indoor unit according to claim 7, wherein the front panel comprises a first panel of which position is varied such that a drain hole is positioned at a place corresponding to the drain pan.

10. An indoor unit for an air conditioner, comprising:

a heat exchanger for performing heat exchange;

a blower part for forcibly blowing air;

a drain pan for draining condensed water generated while the heat exchanger operates;

a connection tube formed at one side of the heat exchanger, for guiding flow of refrigerant, wherein the connection tube has a tube coupling part at each end, for allowing the refrigerant to communicate with either end of the connection tube; and a flow passage guider fixable to either tube coupling part and extendable to an outer side of the indoor unit.

11. The indoor unit according to claim 10, wherein the tube coupling parts are bilaterally symmetric with each other.

12. The indoor unit according to claim 10, wherein the front panel comprises:

a first front panel provided with a penetration hole; and a second front panel separated from the first front panel and provided without the penetration hole.

13. An indoor unit for an air conditioner, comprising:

a blower part for forcibly blowing air;

a heat exchanger for performing heat exchange;

a drain pan provided at one side thereof with a drain part so as to drain condensed water generated while the heat exchanger operates to an exterior;

a front panel provided with a penetration hole at a position corresponding to the drain part;

a connection tube for guiding flow of refrigerant to the heat exchanger, wherein the connection tube has a tube coupling part at each end, for allowing the refrigerant to communicate with either end of the connection tube; and a flow passage guider selectively fixable to either tube coupling part.

14. The indoor unit according to claim 13, wherein the front panel comprises:

a first front panel provided with the penetration hole; and a second front panel separated from the first front panel and provided with out the penetration hole.

15. An indoor unit for an air conditioner, comprising:

a lower frame provided with a suction inlet through which air is inflowed;

a middle frame formed spaced apart upward by a predetermined distance from the lower frame;

a heat exchanger for performing heat exchange;

a drain pan on which the heat exchanger is fixed, the drain pan being provided at one side thereof with a drain part so as to drain condensed water generated while the heat exchanger operates to an exterior;

a front panel provided with a penetration hole at a position corresponding to the drain part;

a connection tube for guiding flow of refrigerant to the heat exchanger, wherein the connection tube has a tube coupling part at each end, for allowing the refrigerant to communicate with either end of the connection tube; and a flow passage guider selectively fixable to either tube coupling part.

16. The indoor unit according to claim 15, wherein the drain pan is selectively mounted on the lower frame or the middle frame.

17. The indoor unit according to claim 15, wherein the position of the drain pan is varied depending on an installation state of the indoor unit.

* * * * *